US005960791A

United States Patent [19]

Winefordner et al.

[11] Patent Number: 5,960,791

[45] Date of Patent: Oct. 5, 1999

[54] DRY SNORKEL

[75] Inventors: Carl Winefordner; Frank Hermansen, both of Corona Del Mar, Calif.

[73] Assignee: Q.D.S. Injection Molding Inc., San Diego, Calif.

[21] Appl. No.: 08/986,673

[22] Filed: Dec. 9, 1997

[51] Int. Cl.[6] ..... B63C 11/16; B63C 11/02; A62B 18/10

[52] U.S. Cl. ..... 128/201.11; 128/201.27; 128/201.28

[58] Field of Search ..... 128/201.11, 201.27, 128/201.26, 201.28, 200.29, 200.24

[56] References Cited

U.S. PATENT DOCUMENTS

| | | | |
|---|---|---|---|
| 2,815,751 | 12/1957 | Ferraro | 128/201.11 |
| 2,909,959 | 10/1959 | Ginden | 128/201.11 |
| 3,166,083 | 1/1965 | Ginden | 128/201.11 |
| 3,345,984 | 10/1967 | Katehis | 128/201.11 |
| 5,117,817 | 6/1992 | Lin | 128/201.11 |
| 5,404,872 | 4/1995 | Choi | 128/201.11 |
| 5,529,057 | 6/1996 | Ferrero et al. | 128/201.11 |
| 5,697,362 | 12/1997 | Albrecht | 128/201.11 |

*Primary Examiner*—John G. Weiss
*Assistant Examiner*—Todd M. Martin
*Attorney, Agent, or Firm*—Leonard Tachner

[57] ABSTRACT

An adaptor assembly which attaches at the upper end opening of the snorkel. The adaptor assembly comprising an upper housing, snaps into the end of the snorkel tube. The snorkel tube follows the contour of the snorkeler's head. The upper housing has a flange to seal against the snorkel tube. The upper housing has a gentle bend at the end that is approximately 90 degrees. A float pivots on pins at a lower area of the upper housing. The float has a suitable light-weight material (low specific gravity) such as closed cell foam held in the lower area and a sealing valve at the upper area. A cover surrounds the upper housing/float housing assembly. The cover that surrounds the upper housing/float housing assembly serves to both protect the moving components and to be a splash guard to keep water from splashing into the opening. When the upper portion of the snorkel is submerged, the float tilts and causes the sealing valve to shut off the opening of the upper housing. The valve will remain shut due to water pressure even if the snorkel is tilted upside down. At any time, the snorkeler can exhale air into the snorkel. If the air pressure exceed ambient, then air pressure will momentarily open the float seal and bubbles will escape. After surfacing, the float housing tilts open and the snorkeler can immediately inhale air.

8 Claims, 6 Drawing Sheets

DRY SNORKEL

BACKGROUND OF THE INVENTION

1. Field of the Invention

The present invention relates generally to the field of snorkels for diving and the like, and more specifically to dry snorkels which are designed to prevent water from entering a snorkel tube while the snorkeler is submerged.

2. Prior Art

When floating up after diving down, the diver is often in urgent need of breathing air in quantities as soon as possible but he or she has to first perform "purging the snorkel" forcefully to clear water out of the snorkel after the snorkel top raises beyond the water surface. This is often difficult because the snorkeler may not have sufficient air remaining in his or her lungs required to purge the snorkel completely.

Oftentimes, the snorkel is insufficiently cleared of water during purging which results in restricted breathing and gurgling water or in worse cases, water inhaled into the mouth and lungs causing choking. Even if the snorkel has a purge valve in the lower housing, if water remains after the initial purge, it is especially difficult to purge out the remaining water because the next forceful blast of air will more easily rush past the water out the snorkel tube top rather than opening the purge valve because significant water pressure holds the purge valve shut. Therefore, if the first purge of air does not adequately clear the snorkel of water, then usually the snorkeler must raise their head above the water, remove the snorkel from their mouth, and manually drain it. This is very inconvenient.

In a conventional snorkel, the opening at the top end thereof is only about 10–15 cm above the water level when the diver is floating. The tail end communicates with the diver's mouth, so a trifling carelessness (such as the snorkel is inclined) or a wave on the water surface may cause water to flow into the snorkel mouth and lead to the danger of swallowing water or choking the bronchia with water.

After purging water from a conventional snorkel, there is usually some residual water remaining in the lower housing. Oftentimes the amount of this residual water is sufficiently little so that the snorkeler may breathe past without significant "gurgling" noises, but is still enough to effectively reduce the breathing passage size such that breathing resistance is increased.

There have been so-called "dry snorkels" made in the past that were designed to keep water from entering the snorkel in the first place. The principle is that when the snorkeler descends below the water, a floating component of the snorkel shuts the upper opening to prevent water from entering the snorkel tube; assuming that the snorkeler keeps the mouthpiece sealed inside their mouth. The first such design had a snorkel tube that curved 180 degrees so that the opening faced the water surface. A ping pong ball (usually) was suspended in a cage below the open snorkel tube. When the snorkel submerges, the ball floats upwards sealing the snorkel tube. The problems with this design are general bulkiness and unattractiveness, and there is a flow restriction caused by the 180 degree bend in the snorkel tube. The general shape is poor for hydrodynamics and tends to catch on things such as seaweed. Also, if the snorkel is full of water due to the diver allowing water to enter the mouthpiece (as happens, for example, when using a SCUBA regulator), the water is more difficult to purge out because of the 180 degree bend. Also, with any dry snorkel, suction is created as the diver descends due to increasing water pressure with depth. At some depth, say 20 feet (about 10 psi), the pressure differential can become painful to the diver's tongue which may be used to block the mouthpiece opening. Additionally, a snorkel of this design is generally dedicated as a dry snorkel only and would not be logically converted into a non-dry model.

Another dry snorkel has an annular coaxial float that seals against an umbrella shaped top. The snorkel tube extends straight up from the snorkeler's temple and flow in and out of the snorkel makes a sharp 180 degree bend to enter and exit the snorkel top. When the diver descends, the annular coaxial float moves upward and seals the entry. This snorkel has the same disadvantages as the ping pong ball version except that it is less bulky and does not hook on to seaweed and such. It also has the disadvantage of extending straight up from the temple rather than following the contour of the snorkeler's head and that causes more hydrodynamic drag.

The patent that appears to be most relevant to the invention is U.S. Pat. No. 5,117,817, Vertical Coaxial Multitubular Diving Snorkel. The disclosed snorkel is much more complex than the inventive design, but also has the feature of being "clean air" in that air is inhaled through the annular area and is exhaled through the coaxial inner tube. This prior art snorkel is very complex and the breathing resistance is very high.

SUMMARY OF THE INVENTION

The present invention effectively improves the conventional snorkel, eliminating the prior art disadvantages mentioned above. These disadvantages include water entering the snorkel during wave surges and splashes and when descending briefly under water; poor hydrodynamics; a shape that may readily catch on floating sea items; an upper tube that does not follow the snorkeler's head contour; painful pressure at depth when using a dry snorkel; the breathing and purging restriction caused by a 180 degree bend at the top of typical dry snorkels; lack of logical conversion to a non-dry snorkel model.

The present invention is characterized by an adaptor assembly which attaches at the upper end opening of the snorkel. The adaptor assembly comprising an upper housing, snaps into the end of the snorkel tube. The snorkel tube follows the contour of the snorkeler's head. The upper housing has a flange to seal against the snorkel tube. The upper housing has a gentle bend at the end that is approximately 90 degrees. A float pivots on pins at a lower area of the upper housing. The float housing has a suitable lightweight material (low specific gravity) such as closed cell foam held in the lower area and a sealing valve at the upper area. A cover surrounds the upper housing/float housing assembly.

The cover that surrounds the upper housing/float housing assembly serves to both protect the moving components and to be a splash guard to keep water from splashing into the opening.

When the upper portion of the snorkel is submerged, the float tilts and causes the sealing valve to shut off the opening of the upper housing. The valve will remain shut due to water pressure even if the snorkel is tilted upside down. At any time, the snorkeler can exhale air into the snorkel. If the air pressure exceeds ambient, then air pressure will momentarily open the float seal and bubbles will escape. After surfacing, the float housing tilts open and the snorkeler can immediately inhale air.

The valve is of proper size and hardness and the upper housing opening designed such that when a certain depth is reached, say 15 feet, the valve will collapse inward allowing water to flood the snorkel to relieve pressure so that the snorkeler does not hurt or damage their mouth or tongue. When surfacing, the float housing tilts back into its open position and the snorkeler must either purge out the water as with conventional snorkels or manually drain the water by taking the snorkel out of their mouth and pouring out the water. Note that because the flow of the water goes through only an 80 or 90 degree bend, purge flow is relatively unrestricted.

Breathing resistance is low both because there no water in the snorkel that restricts breathing and the flow path takes only a modest 80 to 90 degree bend rather than the 180 degree bend of other dry snorkels.

The invention allows economical and logical manufacture of dry and non-dry snorkels using the same lower housing, elbow and tube. Only a new upper housing assembly is needed to provide the advantageous new features.

OBJECTS OF THE INVENTION

It is therefore a principal object of the present invention to provide a dry snorkel which overcomes the aforementioned deficiencies of the prior art.

It is another object of the invention to provide a dry snorkel which is effective against wave surges and splashes and has good hydrodynamics and low breathing resistance.

It is still an additional object of the invention to provide a dry snorkel which utilizes a design permitting easy conversion of a non-dry snorkel model to a dry snorkel model.

It is yet an additional object of the invention to provide a dry snorkel which is responsive to selected depth-related water pressure to collapse a valve and relieve snorkel pressure to prevent pain or injury to the snorkeler.

It is yet an additional object of the invention to provide a dry snorkel having a tube contour which accommodates the shape of the snorkeler's head and which is not likely to catch floating sea items.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 1:
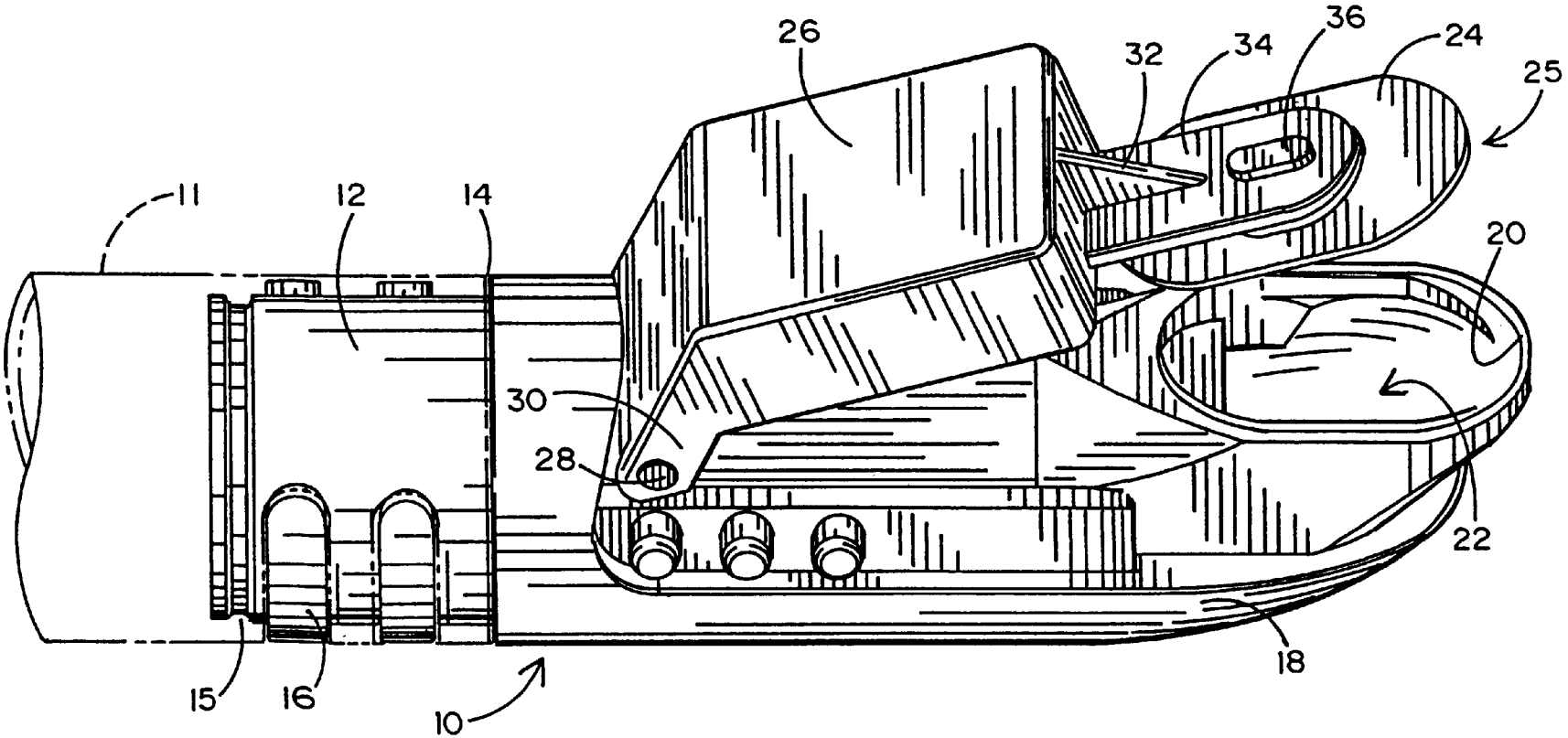
FIG. 1 is a perspective view of a preferred embodiment of the invention.
Figure 2:
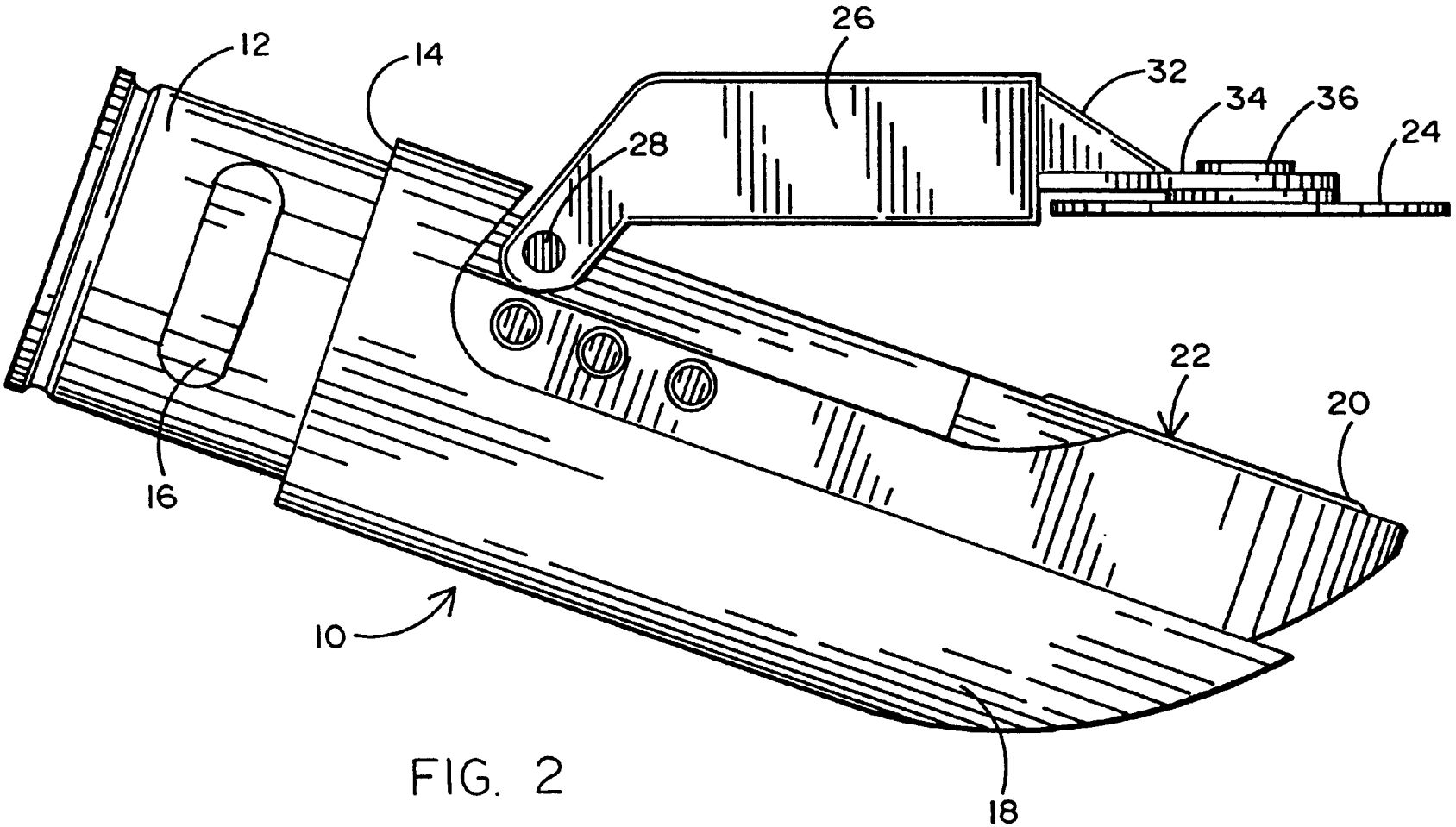
FIG. 2 is a side view of the embodiment of FIG. 1.
Figure 3:
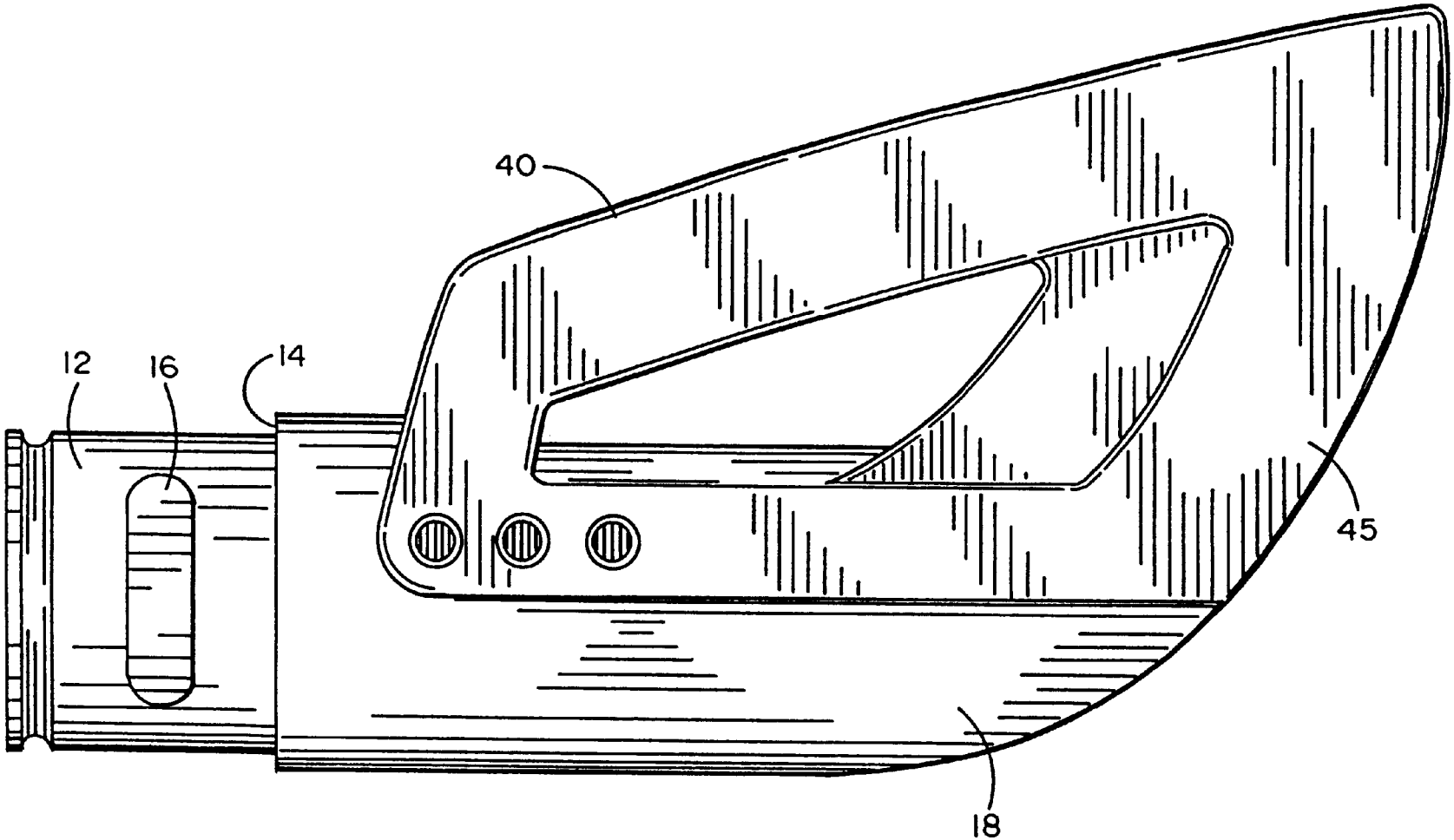
FIG. 3 is a side view similar to that of FIG. 1, but illustrating an optional splash guard which may be added to disclosed embodiment.

Referring to the accompanying figures, and in particular to FIGS. 1 and 2, it will be seen that a dry snorkel adapter assembly 10, in accordance with a preferred embodiment of the invention, comprises a mating cylinder 12 having a plurality of locking flanges 16 for mating axially with a snorkel tube 11. The flanges mate with corresponding elongated apertures (not shown) in the tube. A flange that is bigger than the tube 11 internal diameter, which is made of a semi-rigid material is provided for sealing the interface between the snorkel tube 11 and the mating cylinder 12. Alternatively, an O-ring seal could have been integrated. Cylinder 12 is integral to a body 18 at a shoulder 14.

Body 18 is essentially an elongated hollow tube terminating in an opening 20 which provides an exit for exhaust air and an entrance for fresh air through passage 22. Body 18 is designed to provide about a 90 degree bend to passage 22 so that air travel through opening 20 is approximately perpendicular to air traveling through cylinder 12 and the adjacent portion of body 18. Air flow through passage 22 is controlled by a valve 25. The valve comprises a closure member 24 and a float member 26 as well as a holder 34, interface 36 and brace 32, the latter three elements providing a structural interface between members 24 and 26. Float member 26 has a pair of arms 30 terminating in respective apertures which rotationally engage corresponding pins 28 thereby securing valve 25 to body 18 and permitting the valve to open and close passage 22.

Figure 4:
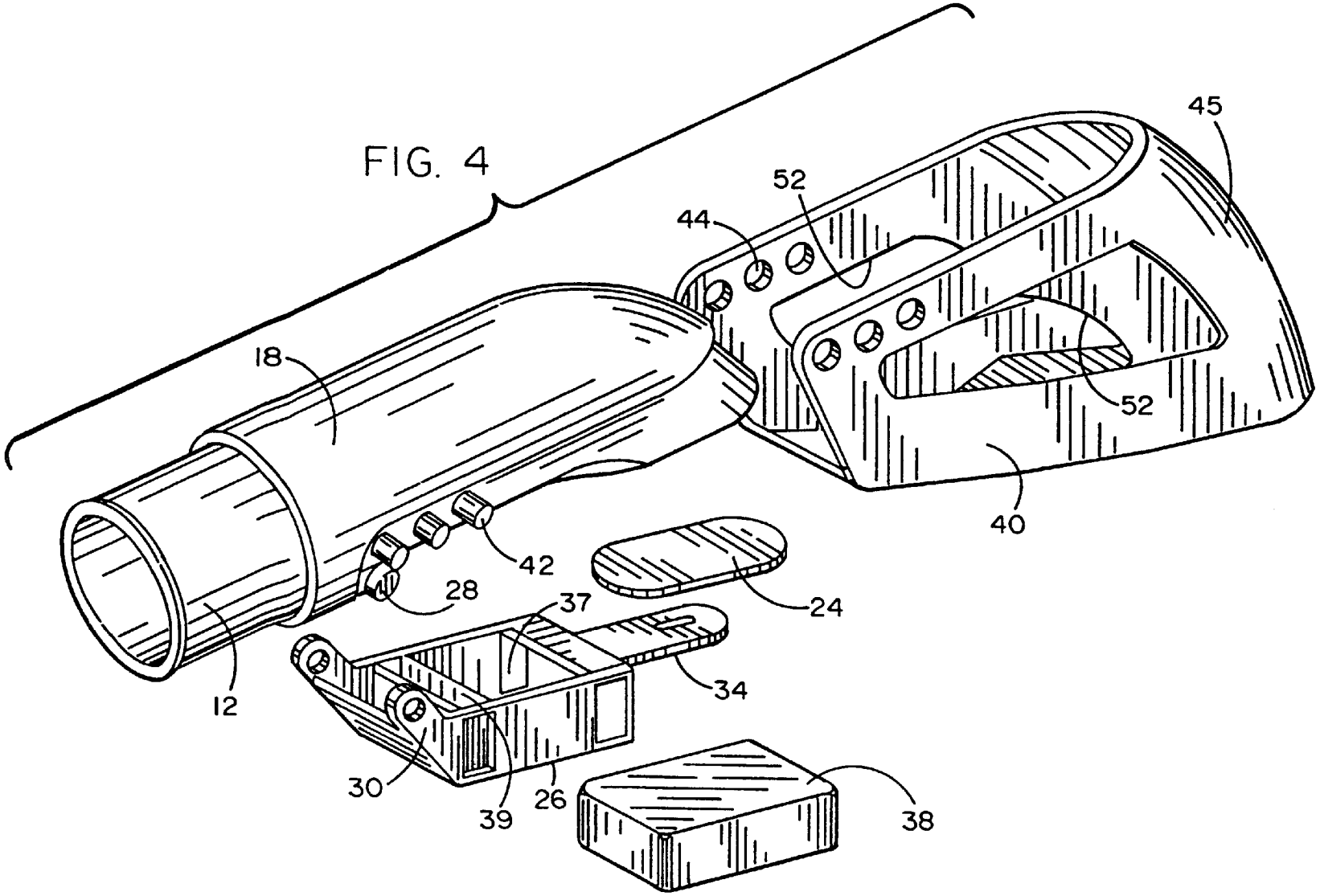
FIG. 4 is a three-dimensional exploded view of the disclosed embodiment.
Figure 5:
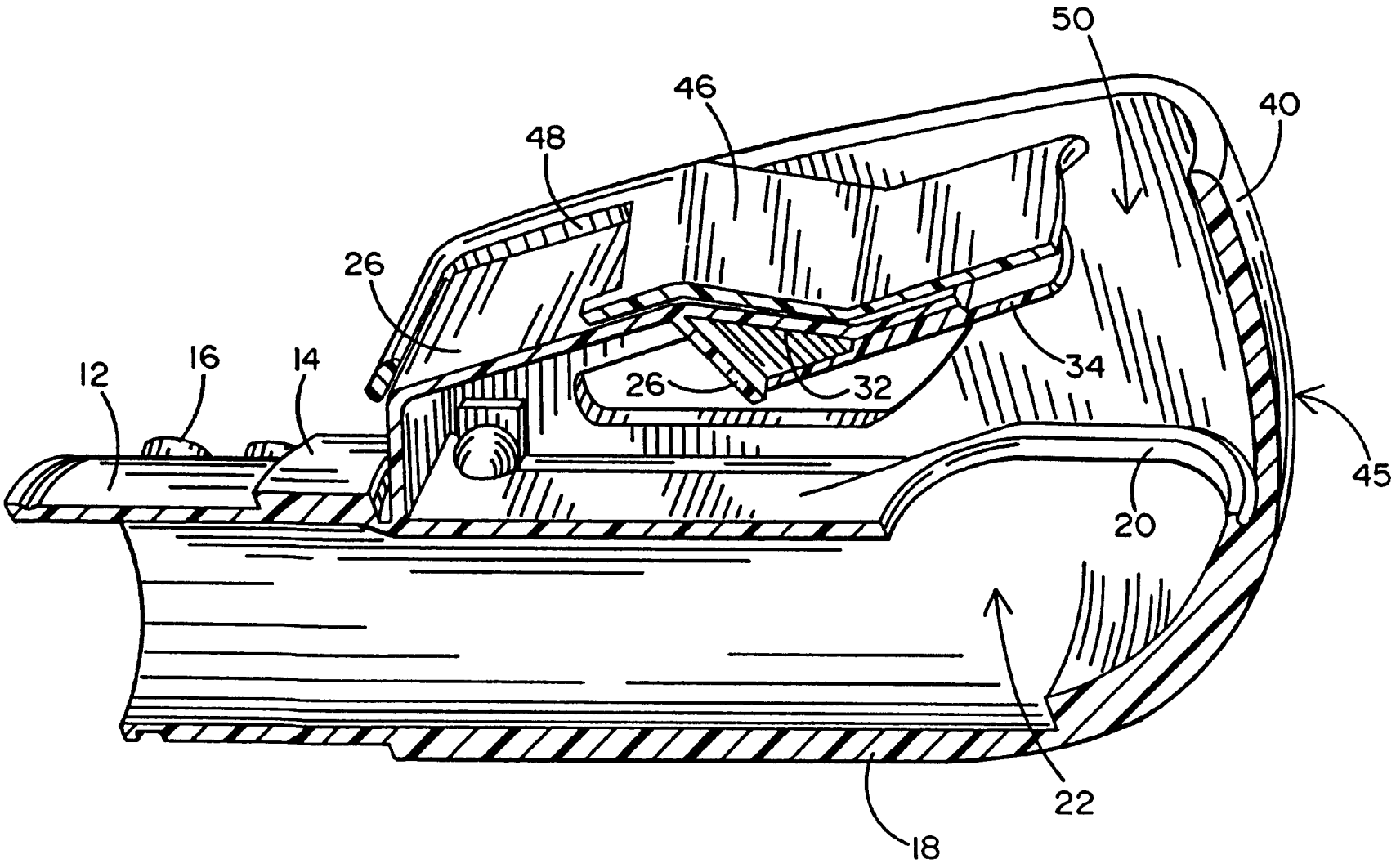
FIG. 5 is a cut-away view of the invention.
Figure 6:
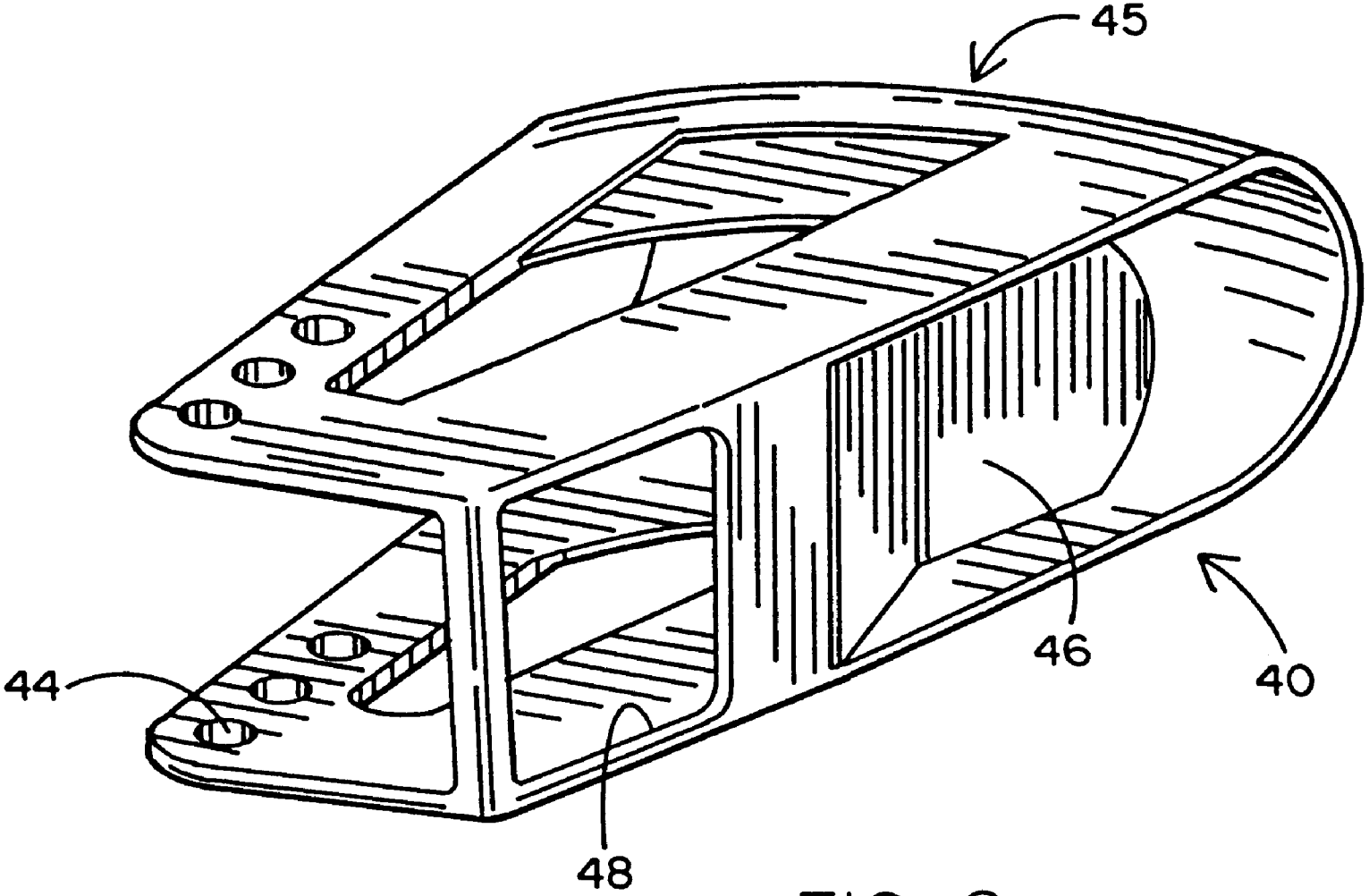
FIG. 6 is a three-dimensional view of the splash guard.

As seen best in FIG. 4, float member 26 comprises a generally rectangular compartment 37 enclosed on three sides by the walls of float member 26 and an interior wall 39. Compartment 37 is thus adapted to receive a rectangular form of foam 38 which may be readily compressed into the compartment to provide a highly buoyant mass in float member 26.

An optional feature of the preferred embodiment, comprises a splash guard 40 which is shown in FIGS. 3–6. The splash guard is designed to connect to the body 18 by means of interconnection of pins 42 of the body with holes 44 of the guard. The guard provides a cover portion 45 which substantially encompasses valve 25 and opening 20 and thereby prevents water splash from entering passage 22 when the diver is at the surface of the water. The guard is designed to provide freedom of movement for valve 25 and its support structure while minimizing resistance to water and air expelled by the snorkeler through passage 22. More specifically, guard 40 comprises contoured wall 46, front windows 48 and 50 and side windows 52.

In operation, when the snorkeler is fully submerged, valve 25, by virtue of the buoyancy of float member 26, closes opening 20 and prevents water from entering passage 22. The valve can still be opened when the snorkeler exhales forcefully creating sufficient pressure within passage 22 to overcome the force closing valve 25. When the snorkeler approaches the surface and the top of the snorkel exits the water, the buoyancy effect on the float member vanishes and allows gravity to open the valve, permitting the snorkeler to inhale freely through opening 20 and passage 22. Splash guard 40 prevents water from entering the opening 20 while permitting valve 25 to open fully and while having no significant impact on air resistance at purging. If the snorkeler dives deeply, closure member 25 is sufficiently flexible to eventually collapse partially into opening 20 upon reaching a selected pressure differential between the interior of passage 22 and the ambient water pressure.

It will now be understood that the invention herein disclosed meets all of the aforementioned objects. It will also be understood that while a preferred embodiment has been described in detail, the invention is not necessarily limited by such exemplary disclosure, but only by the appended claims and their equivalents.

We claim:

1. A snorkel adaptor assembly for attachment to the upper end of a conventional snorkel tube for converting the snorkel to a dry snorkel; the adaptor assembly comprising:

a mating cylinder for connecting said assembly to said snorkel tube, said mating cylinder having an axis and being integral to a tubular body having a substantial right angle turn terminating in an opening having an axis that is substantially perpendicular to said mating cylinder axis and being in communication with a passage throughout said body;

a valve attached to said body for limited articulated movement relative to said body, said valve having a closure member for engaging and closing off said opening and a float member that is buoyant in water, said float member being affixed to said closure member for closing said opening under water;

a collapsible rubber-like resilient material for sealing said opening upon closure of said valve and for collapsing into said opening at a selected depth in said water.

2. The adaptor assembly recited in claim 1 wherein said float member comprises a low density material.

3. The adaptor assembly recited in claim 2 wherein said low density material is a closed cell foam.

4. The adaptor assembly recited in claim 1 further comprising a splash guard attached to said body and overlying said opening for preventing inadvertent water entry into said opening when said assembly is above the surface of water and said valve is open.

5. A dry snorkel comprising:

a snorkel tube having an upper opening for air and water passage therethrough;

an adaptor assembly attached to said snorkel tube, said assembly having a mating cylinder having an axis and connecting said assembly to said snorkel tube, said mating cylinder being integral to a tubular body having a substantial right angle turn terminating in an opening directed substantially perpendicular to said mating cylinder axis and being in communication with a passage throughout said body;

a valve attached to said body for limited articulated movement relative to said body, said valve having a closure member for engaging and closing off said opening and a float member that is buoyant in water, said float member being affixed to said closure member for closing said opening under water;

a collapsible rubber-like resilient material for sealing said opening upon closure of said valve and for collapsing into said opening at a selected depth in said water.

6. The dry snorkel recited in claim 5 wherein said float member comprises a low density material.

7. The dry snorkel recited in claim 6 wherein said low density material is a closed cell foam.

8. The dry snorkel recited in claim 5 further comprising a splash guard attached to said body and overlying said opening for preventing inadvertent water entry into said opening when said assembly is above the surface of water and said valve is open.

* * * * *